US006016632A

United States Patent [19]

McGee et al.

[11] Patent Number: 6,016,632

[45] Date of Patent: Jan. 25, 2000

[54] MODULAR WALL SYSTEM

[75] Inventors: Wayne R. McGee, Chesterfield; Scott Schormann, O'Fallon; Scott Kouri, St. Louis; Trace Woodrum, Ballwin, all of Mo.

[73] Assignee: Porta-Fab Corporation, Chesterfield, Mo.

[21] Appl. No.: 08/738,857

[22] Filed: Oct. 28, 1996

[51] Int. Cl.[7] ..... E04B 2/74

[52] U.S. Cl. ..... 52/241; 52/281; 52/282.2; 52/464; 52/584.1; 52/731.5; 52/733.2; 52/737.6; 52/775

[58] Field of Search ..... 52/235, 584.1, 52/463, 464, 467, 468, 204.705, 204.62, 241, 242, 280, 281, 282.1, 282.2, 731.5, 731.9, 733.2, 737.6, 775

[56] References Cited

U.S. PATENT DOCUMENTS

| | | | |
|---|---|---|---|
| 2,962,133 | 11/1960 | Kivett et al. . | |
| 2,994,413 | 8/1961 | Levy et al. . | |
| 3,026,977 | 3/1962 | Pollock et al. . | |
| 3,039,569 | 6/1962 | Bohnsack . | |
| 3,066,770 | 12/1962 | Millard et al. . | |
| 3,072,226 | 1/1963 | Harwood . | |
| 3,073,420 | 1/1963 | Olsen . | |
| 3,139,960 | 7/1964 | Hammitt et al. | 52/733.2 X |
| 3,159,250 | 12/1964 | Wilson | 52/733.2 X |
| 3,180,457 | 4/1965 | Bohnsack . | |
| 3,185,267 | 5/1965 | Pavlecka . | |
| 3,266,207 | 8/1966 | Birum, Jr. . | |
| 3,267,631 | 8/1966 | Hammitt . | |
| 3,282,007 | 11/1966 | Campbell et al. . | |
| 3,305,981 | 2/1967 | Biggs et al. . | |
| 3,339,324 | 9/1967 | Stackhouse . | |
| 3,342,001 | 9/1967 | Arnd | 52/775 |
| 3,449,877 | 6/1969 | Beckman . | |
| 3,451,183 | 6/1969 | Lespagnol et al. . | |
| 3,533,205 | 10/1970 | Pestel et al. . | |
| 3,538,658 | 11/1970 | Lavalley et al. . | |
| 3,559,357 | 2/1971 | Lowe . | |
| 3,566,561 | 3/1971 | Tozer . | |
| 3,782,048 | 1/1974 | Corman . | |
| 3,852,935 | 12/1974 | Jones . | |
| 3,924,374 | 12/1975 | Volper . | |
| 4,109,440 | 8/1978 | Bill . | |
| 4,192,119 | 3/1980 | Murphy . | |

(List continued on next page.)

FOREIGN PATENT DOCUMENTS

| | | |
|---|---|---|
| 583107 | 9/1959 | Canada . |
| 0671519 A2 | 3/1995 | European Pat. Off. . |
| 1288200 | 2/1962 | France . |
| 1186549 | 4/1970 | United Kingdom . |

*Primary Examiner*—Laura A. Callo
*Attorney, Agent, or Firm*—Howell & Haferkamp, L.C.

[57] ABSTRACT

A modular wall system comprising a framing assembly supporting a plurality of wall panels. The framing assembly includes top members, bottom members, and studs extending between the top and bottom members for supporting the wall panels. Each stud has a generally rectangular cross-section with a front face, a back face, and left and right side faces. The front face has a recess therein with a longitudinally extending ridged trough therein for receiving threaded fasteners. The back face having an outwardly-opening generally C-shaped channel with a longitudinally extending ridged trough therein for receiving threaded fasteners. Each side face has a generally centrally located, longitudinally extending groove with a ridged trough in the groove for receiving threaded fasteners, at least one longitudinally extending gasket to seal against the edge of a panel mounted on the side of the stud, and an insert mounting slot between the groove and each gasket mounting slot; and a cover strip mounted over the front face of the stud, the cover strip having a generally T-shaped cross-section adapted to interfit with the front face of the stud with the stem of the "T" fitting in the recess in the front face, and the arms of the "T" extending laterally beyond the side edges of the front face to overlap edge margins of the front face of a panel mounted on the side of the stud, and a plurality of threaded fasteners extending through the stem of the "T" shaped cross-section of the cover and into the ridged trough in the front face of the stud.

12 Claims, 12 Drawing Sheets

U.S. PATENT DOCUMENTS 4,266,387 5/1981 Karlsson .
4,271,238 6/1981 Braithwaite et al. .
4,287,697 9/1981 Matsubara et al. .
4,570,402 2/1986 Johnson .
4,757,657 7/1988 Mitchell et al. .
4,798,035 1/1989 Mitchell et al. .
4,821,476 4/1989 Thoburn et al. ..... 52/282.1 X
4,953,333 9/1990 Carlson .
4,984,400 1/1991 Bockmiller .
5,228,254 7/1993 Honeycutt, Jr. .
5,233,803 8/1993 Bockmiller .
5,307,596 5/1994 Bockmiller .
5,307,600 5/1994 Simon, Jr. et al. .
5,371,981 12/1994 Bockmiller .
5,414,967 5/1995 Cates et al. .
5,634,300 6/1997 Huebner et al. .

MODULAR WALL SYSTEM

FIELD OF THE INVENTION

This invention relates to modular wall systems, and in particular to a framing system for supporting wall panels in a modular wall system.

BACKGROUND OF THE INVENTION

Modular wall systems provide fast, easy, and economical construction of walls and rooms for dividing work spaces, providing enclosures for certain equipment or activities, maintaining a controlled environment for storage or for certain manufacturing processes, and providing office space. These modular wall systems include a frame assembly that supports wall panels. To fully realize all of the benefits of modular construction, it is important that the modular system have as few components as possible, and that the components can be easy to use and assemble without special tools, and with a minimum of special hardware. While a number of modular wall systems are available today, many of these systems require special fasteners and/or special tools for these fasteners. Furthermore, many of these systems have a large number of different parts, for example, requiring special parts to frame doors or windows.

SUMMARY OF THE INVENTION

The modular wall system of the present invention provides great flexibility in design and construction, while minimizing the number of components required, and using readily available, conventional hardware and eliminating the need for special tools and equipment.

Generally, the framing system includes top members, bottom members, and studs extending between the top and bottom members for supporting the wall panels. Each stud has a generally rectangular cross-section with a front face, a back face, and left and right side faces. The front face has a recess therein with a longitudinally extending ridged trough therein for receiving threaded fasteners. The back face has an outwardly-opening generally C-shaped channel with a longitudinally extending ridged trough therein for receiving threaded fasteners. Each of the side faces has a generally centrally located, longitudinally extending groove with a ridged trough in the groove for receiving threaded fasteners. There is preferably at least one longitudinally extending gasket on each side face to seal against the edge of a panel mounted on the side of the stud. There are also preferably insert mounting slots on each side face of the stud, for mounting inserts to accommodate panels of different thicknesses.

The stud also includes at least one cover strip for the front face of the stud, and preferably two cover strips, one for the front face and one for the back face of the stud. These cover strips have a generally T-shaped cross-section, with the stem of the "T" fitting in the recess in the front face (or the opening in the C-shaped channel on the back face), and the arms of the "T" extending laterally beyond the side edges of the face. On the front, the cover strip overlaps the front face of a panel mounted adjacent the stud. On the back face, the cover either overlies the back face of the panel or the insert installed on the stud to accommodate a thinner panel without the cover strip. The cover strip can be secured with standard threaded fasteners that extend through a channel in the cover strip, and into the ridged troughs in the front and back faces of the stud.

The grooves in the side faces of the stud are adapted to receive one leg of an L-shaped bracket that can be used to secure the stud to a top member, a bottom member, or another stud. Thus the studs can be used in both vertical and horizontal orientations. The L-shaped bracket is secured in the groove with standard threaded fasteners that extend through the bracket and into ridged troughs in the grooves.

Thus, the modular wall system of this invention includes a frame assembly for mounting panels that has a minimum number of parts. The frame assembly includes top members and bottom members and studs. These studs are easily secured to the top and bottom members, and to each other with simple brackets and conventional fasteners, so that construction is quick and easy. Moreover, this allows the studs to be used as both horizontal and vertical members in the frame assembly, without the need for additional special purpose components. The studs can be provided with special inserts to accommodate different thicknesses of panels.

These and other features and advantages will be in part apparent, and in part pointed out hereafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
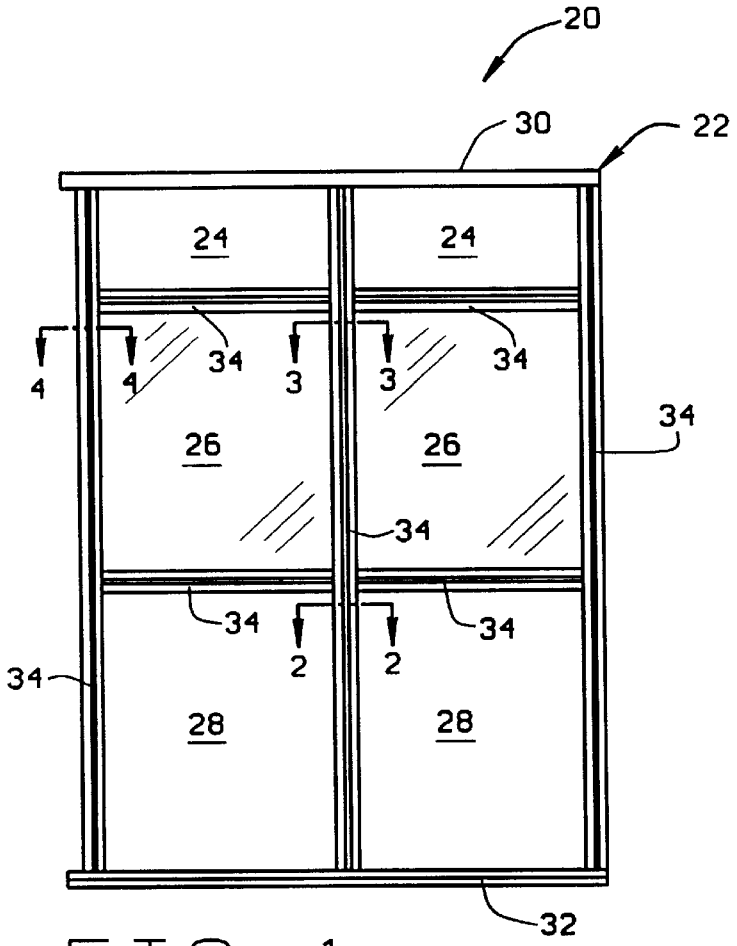
FIG. 1 is an exterior elevation view of a wall constructed with a modular wall system in accordance with the present invention.

A wall constructed with a modular wall system in accordance with the present invention is indicated as 20 in FIG. 1. The wall 20 comprises a frame assembly 22 and a plurality of wall panels 24, 26, and 28. The panels 24 and 28 are conventional wall panels comprising front and back facings with an aluminum honeycomb core or other suitable core approximately 1.81 inches (5.08 cm) thick. The frame assembly 22 comprises a top member 30, a bottom member 32, and a plurality of studs 34. Some of the studs 34 extend vertically between the top member 30 and the bottom member 32. Some of the studs 34 extend horizontally between vertically extending studs vertically separating the panels and framing windows and other structures. In the prior art systems special components were used for horizontal members, and for framing door and window openings, increasing the cost and complexity of such systems.

Figure 7:
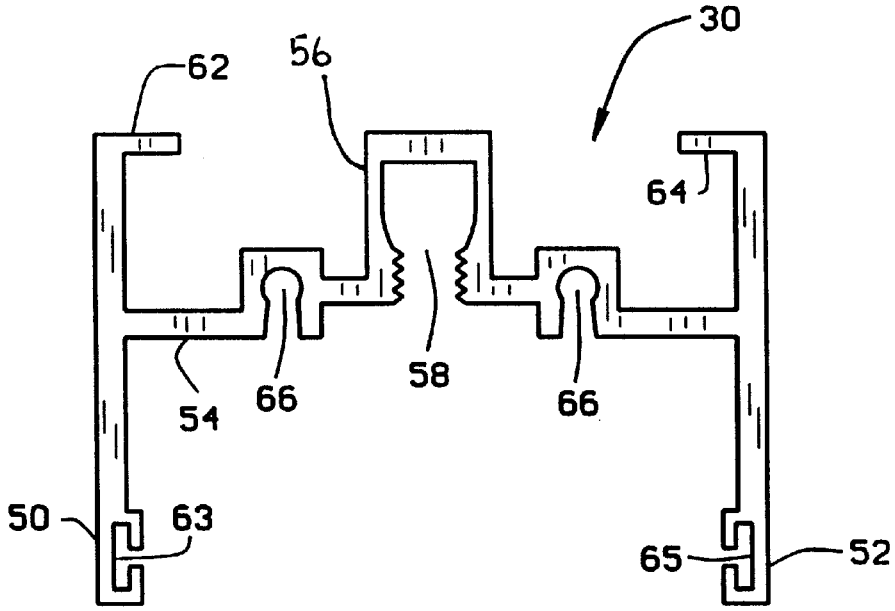
FIG. 7 is a left end view of a top member for a framing system constructed in accordance with the present invention.
Figure 13:
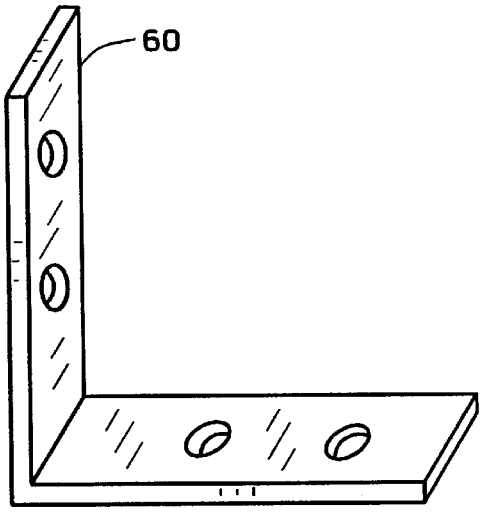
FIG. 13 is a perspective view of the L-shaped bracket for joining the components of the frame assembly.

A top member 30 is shown in cross-section in FIG. 7, and comprises a generally vertical front web 50, a generally vertical rear web 52, and a horizontal web 54 extending between the front web and the rear web. The bottom surface of the horizontal web 54 has a longitudinally extending groove 56, with a ribbed or ridged trough 58 therein. The groove 56 is adapted to receive one leg of an L-shaped bracket 60 (FIG. 13) for connecting the components of the frame assembly 22. Threaded fasteners can extend through the leg of the bracket 60 in the groove 56, and into the ridged trough 58 to secure the bracket to the top member 30. There are inwardly extending flanges 62 and 64 on the top edges in the same plane as the end of the trough 58, and T-slots 63 and 65 at lower portion, of the front and back webs 50 and 52. Mounting slots 66 are positioned on either side of the grooves, for mounting inserts for accommodating panels of different sizes and types. The mounting slots 66 have a generally key-hole shaped cross-section. The top member 30 is preferably made of extruded aluminum, although it could be made of any other suitable material.

Figure 8:
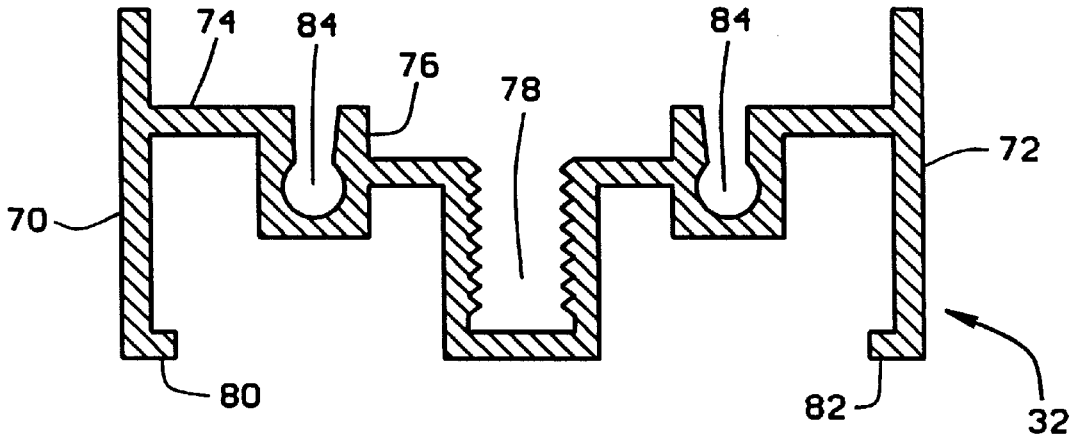
FIG. 8 is a cross-sectional view of a bottom member for a framing system constructed in accordance with the present invention.

A bottom member 32 is shown in cross-section in FIG. 8, and comprises a generally vertical front web 70, a generally vertical rear web 72, and a horizontal web 74 extending between the front web and the rear web. The top surface of the horizontal web 74 has a longitudinally extending groove 76, with a ridged trough 78 therein. The groove 76 is adapted to receive one leg of the L-shaped bracket 60 (FIG. 13) used for connecting the components of the frame assembly 22. Threaded fasteners can extend through the leg of the bracket 60 in the groove 76, and into the ridged trough 78 to secure the bracket to the bottom member 32. There are inwardly extending flanges 80 and 82 on the bottom edges of the front and back webs 70 and 72, in the same plane as the end of the trough 78. Mounting slots 84 are positioned on either side of the groove 76, for mounting inserts for accommodating panels of different sizes and types. These mounting slots 84 preferably have a generally key-hole shaped cross-section. The bottom member 32 is preferably made of extruded aluminum, although it could be made of any other suitable material.

Figure 2A:
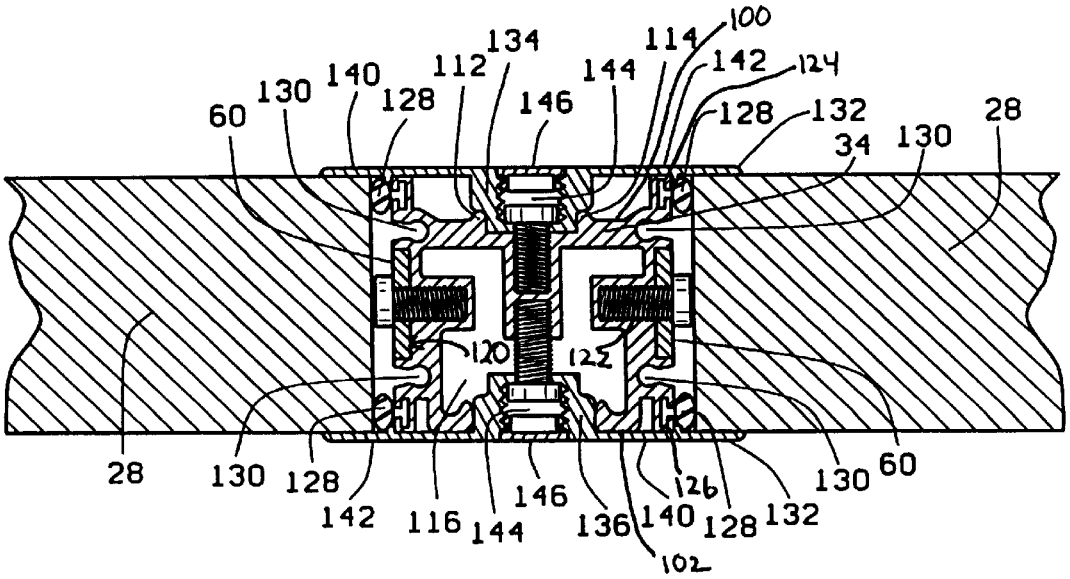
FIG. 2A is a partial cross-sectional view taken along the plane of line 2—2 in FIG. 1, showing a stud mounting two 1⅞" wall panels.
Figure 2B:
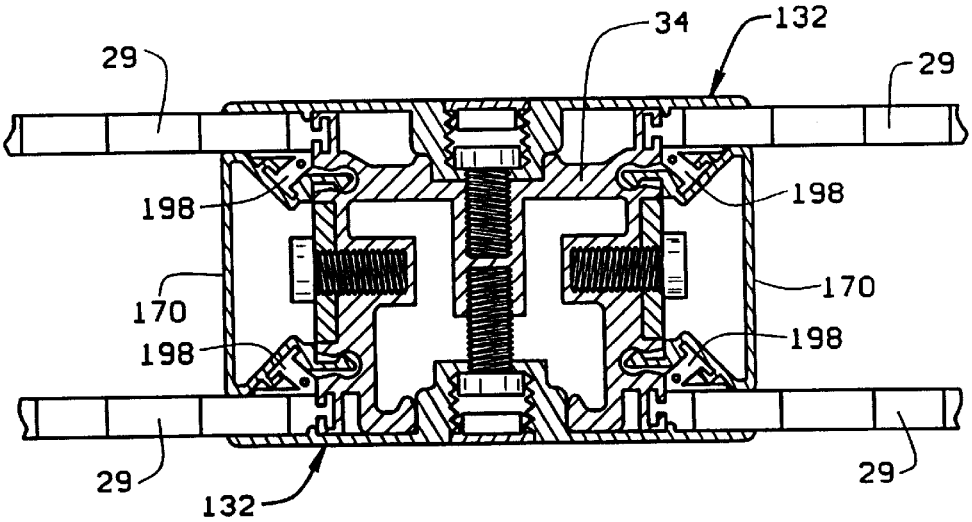
FIG. 2B is a similar view except that the stud is configured to mount two ¼" panels.
Figure 9:
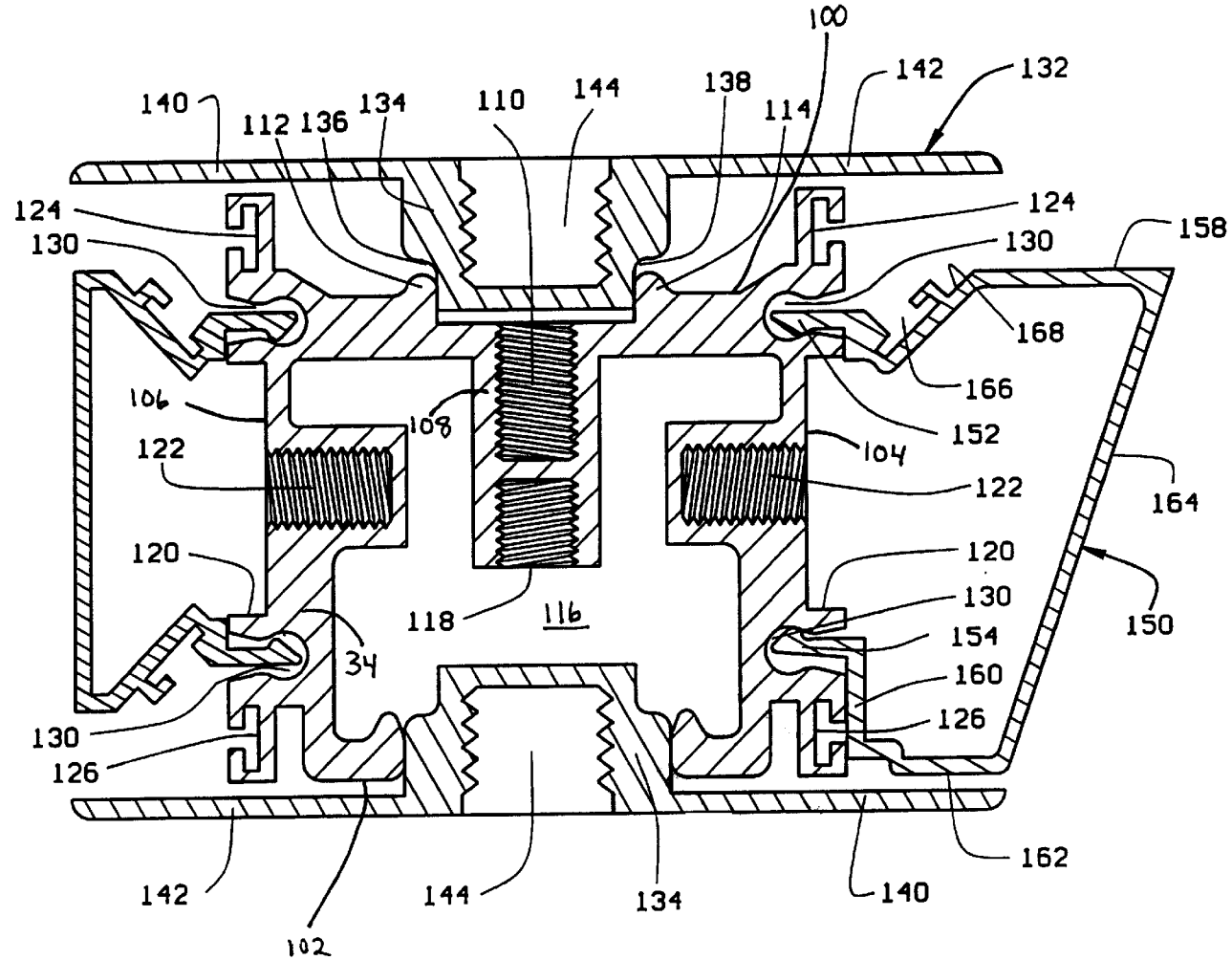
FIG. 9 is a cross-sectional view of a stud for a framing system constructed in accordance with the present invention.

A stud 34 is shown in cross-section in FIG. 9. The stud 34 has a generally rectangular cross-section, with a front face 100, a rear face 102, a left face 106 and a right face 104. The front face 100 has a generally centrally located recess 108 therein with a longitudinally extending ridged trough 1 10 therein for receiving threaded fasteners. There are ribs 1 12 and 1 14 on either side of the trough 110. The back face 102 of the stud 34 has an outwardly-opening generally C-shaped channel 116, with a longitudinally extending ridged trough 118 therein for receiving threaded fasteners. The C-shaped channel 116 is of standard size and configuration to be compatible with conventional commercial channel systems such as Globestrut, UNISTUT®, and B-Line Systems. As shown in FIGS. 2A and 2B, the C-shaped channel 116 extends from the back face 102 of the stud 34 to beyond more than half of the width of the left face 106 and right face 104. The C-shaped channel 116 allows conduits, ducts, pipes and other structures to be mounted on the walls or buildings constructed with the modular building.

Each of the side faces 104 and 106 of the stud 34 has a generally centrally located, longitudinally extending groove 120 with a ridged trough 122 in the groove for receiving threaded fasteners. There are preferably two inverted T-shaped slots 124 and 126 on each side, adjacent the front edge and the back edge, respectively. Longitudinally extending gaskets 128 (FIG. 14) can be mounted in the slots 124 and 126, to seal against the edges of panels mounted adjacent the stud 34. There are also mounting slots 130 on each side of the groove 120, for mounting inserts for accommodating panels of differing sizes.

Figure 12:
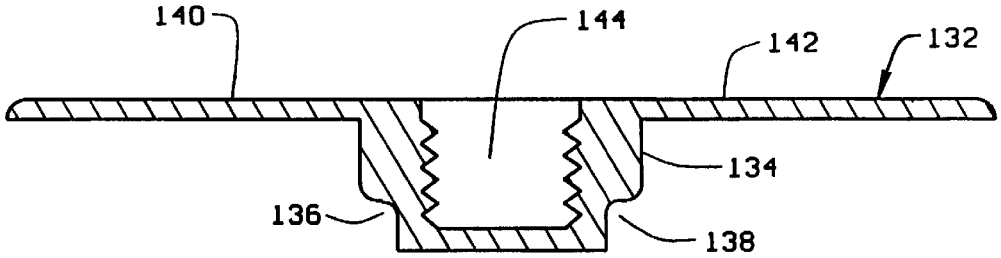
FIG. 12 is a cross-sectional view of the cover strip.

The stud 34 preferably includes at least one cover strip 132 adapted to be mounted over the front face 100 and preferably a second cover strip adapted to be mounted over the back face 102 of the stud. As shown in FIG. 12, the cover strip 132 has a generally T-shaped cross-section adapted to interfit with the front face 100 of the stud with the stem 134 of the "T" fitting in the recess 108 in the front face. The bottom end of the stem 134 has notches 136 and 138 therein for receiving the ribs 112 and 114, respectively. The arms 140 and 142 of the "T" extending laterally beyond the side edges of the front face to overlap edge margins of the front face of a panel mounted on the side of the stud. There is a ridged channel 144 in the top of the "T" of the cover strip 132. A plurality of threaded fasteners extend through the channel 144 in the stem 134 of the "T" and into the ridged trough 110 in the front face 100 to secure the cover strip. The cover strip 132 could also receive fasteners to support hanging and mounting of conduit, duct, etc., without requiring removal of strip 132 from stud 34. The cover strip 132 is preferably made of extruded aluminum.

The cover strip 132 is preferably also adapted to engage the back face 102 of the stud 34, with the stem 134 of the "T" fitting in the opening of the C-channel 116, and the arms 140 and 142 of the "T" extending laterally beyond the side edges of the back face to overlap edge margins of the back face of a panel mounted on the side of the stud, or to overlap the back face of an insert installed on the stud to accommodate panels of different thickness. The cover strip 132 is secured to the back face 102 of the stud 34 with a plurality of threaded fasteners that extend through the channel 144 in the stem 134 of the "T" and into the ridged trough 118. A flexible extruded cover 146 (FIG. 16) can fit in the top of the channel 144 to hide the heads of the fasteners in the channel 144.

Several different inserts can be provided to mount on the studs 34 to permit the stud to mount panels of different sizes and types.

Figure 10:
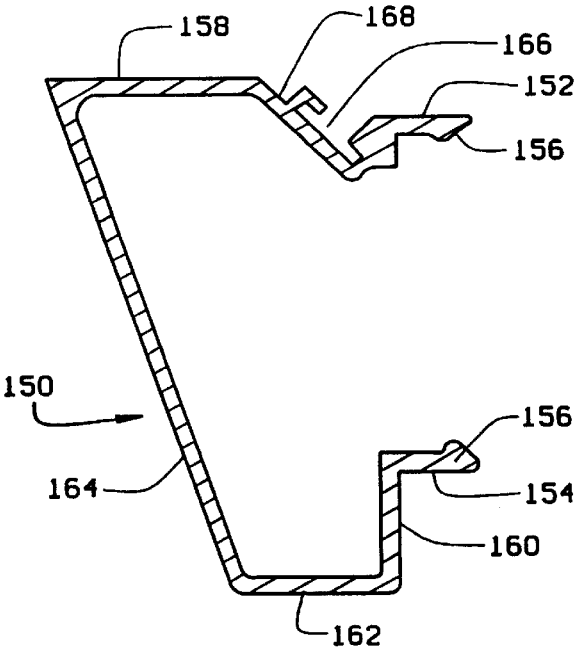
FIG. 10 is a cross-sectional view of an insert for use with the stud for mounting thin panels.

One possible insert 150 is shown in FIG. 10. The insert 150 has ribs 152 and 154 adapted to fit in the mounting slots 130 on the side of the stud 34, or the slot 66 in the top member 30 or in slots 84 in the bottom member 32. The ribs have enlarged barbs 156 for retaining the ribs in the slots 130 (or slots 66 or slots 84). The insert 150 has a front face 158 forming a seat for a panel mounted adjacent the stud (or other member) on which the insert is mounted, so that the arm of the cover strip sandwiches the edge margins of the panel against the front face 158. The insert 150 also has a portion 160 that extends rearwardly to the back face of the stud, a back face 162 in the same plane as the back face of the stud, and a sloped face 164 between the end of the back face 162 and the end of the front face 158. The insert 150 also has an inverted T-shaped slot 166 on an angled face 168 adjacent the front face 158, for holding a gasket 198 (FIG. 15) to seal against a panel engaging the insert.

Figure 11:
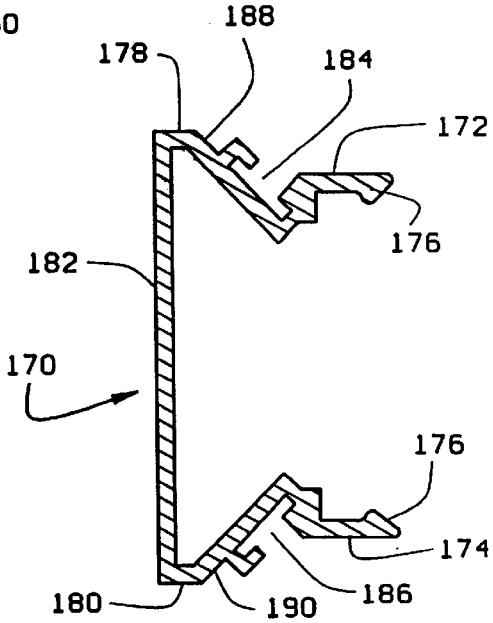
FIG. 11 is a cross-sectional view of another insert for use with the stud for mounting two thin panels.

A second possible insert 170 is shown in FIG. 11. The insert 170 has ribs 172 and 174 adapted to fit in the mounting slots 130 in one of the side faces of the stud 34. The ribs have enlarged barbs 176 for retaining the ribs in the slots 130 in the side faces of a stud, or in the slots 66 in the top member 30 or in the slots 84 in the bottom member. The insert 170 has a front face 178 and a rear face 180 forming seats for panel mounted adjacent the stud on which the insert is mounted, so that the arms of the cover strips on the front face and back face of the stud sandwich the edge margins of the panels against the front and rear faces 178 and 180 of the insert 170. A side face 182 extends between the ends of the front face 178 and the back face 180. The insert 170 also has inverted T-shaped slot 184 and 186 on angled faces 188 and 190 adjacent the front and back faces 178 and 180 of the insert 170, for holding gaskets 198 to seal against panels engaging the insert.

Figure 5:
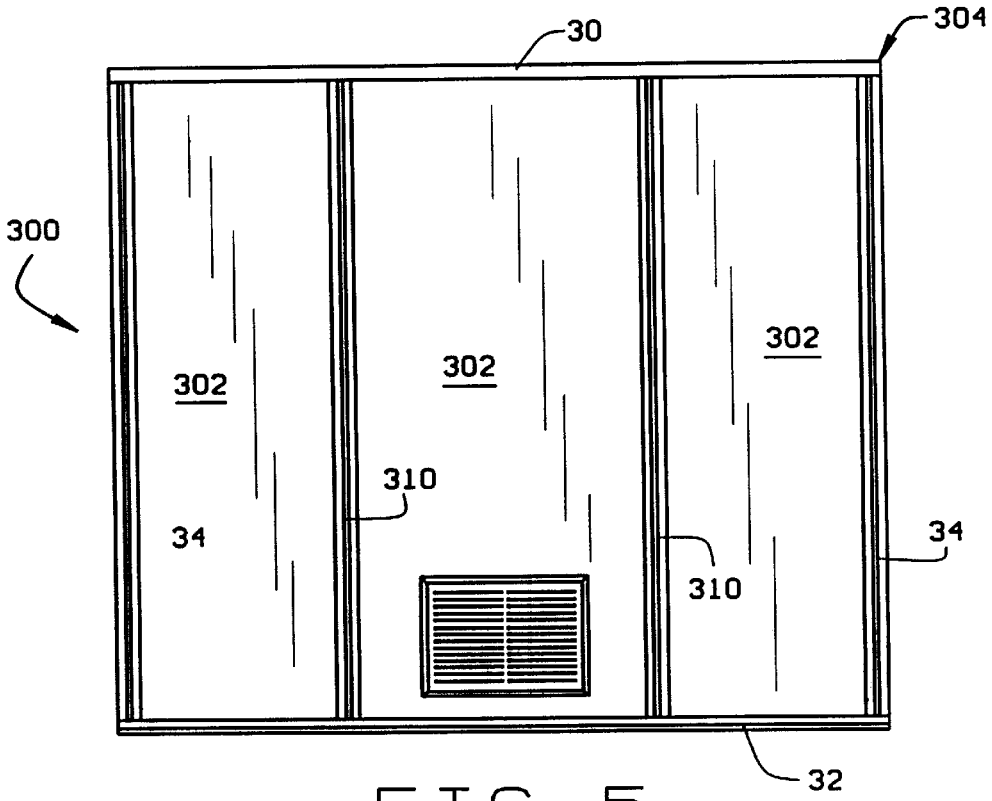
FIG. 5 is an exterior elevation view of a second wall constructed with the modular wall system.
Figure 6:
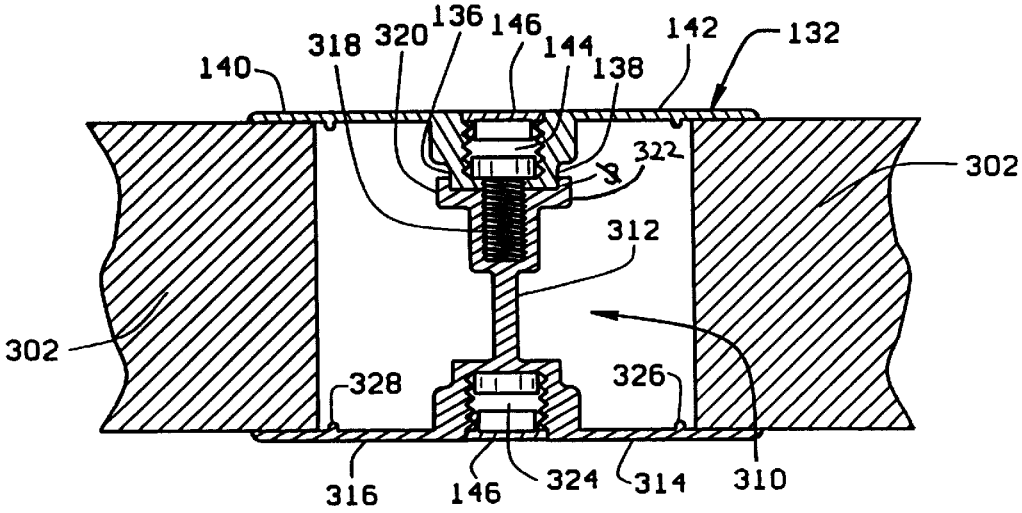
FIG. 6 is a partial cross-sectional view taken along the plane of line 6—6 in FIG. 5, showing a simplified stud for mounting two wall panels.

As shown in FIG. 5, a second wall 300 constructed in accordance with the present invention comprises a plurality of fill length panels 302 supported by a frame assembly 304. The frame assembly 304 comprises top members 30, bottom members 32, and studs 34 and 310. As shown in FIG. 6, where full length panels 302 are used, there is no need for connections with transversely extending members, and a simplified stud 310 can be used.

The simplified stud 310 is shown in FIG. 6. This simplified stud 310 has a generally T-shaped cross-section, comprising a stem 312 and arms 314 and 316. There is a ridged trough 318 at the bottom of the stem 312. The trough 318 is surrounded on each side by lips 320 and 322. There is also a ridged channel 324 at the top of the stem 312. The undersides of the arms 314 and 316 have ribs 326 and 328, respectively for engaging the edges of the wall panels, and spacing them apart. The cover strip 132 can be secured to the bottom of the stem 312, to mount the panels. The notches 136 and 138 in the bottom of the stem on the T-shaped cover strip 132 interfit with the lips 320 and 322. A threaded fastener extends through the channel 144 in the stem of cover strip 132 and into the ribbed trough 318. A cover 146 can be placed in the channel 144 of the cover strip, and the channel 324 of the stud 310, to hide the fasteners and provide a finished appearance.

OPERATION

As shown in FIG. 2A, the stud 34 easily adapts to mount panels of different sizes. In FIG. 2A, the stud 34 is shown mounting panels 28 on each side. The panels 28 have the same thickness as the studs 34. In the preferred embodiment 1.875 inches (5.08 cm). One leg of the L-shaped bracket 60 is secured in the groove 120 on each side face of the stud 34 with a threaded fastener that extends into the ridged trough 122. Gaskets 128 are mounted on the sides of the studs 34, in the slots 124 and 126, to sealingly engage the edges of the panels. Cover strips 132 are mounted over the front face 100 and the back face 102 of the stud 34. The arms 140 and 142 of the cover strips 132 overlap the edge margins of the front and back faces of the panels, holding the panels securely.

In FIG. 2B, the stud 34 is shown including inserts 170 to mount ¼" panels 29. For ease of illustration and understanding, in FIG. 2B, many reference numerals indicating the various elements of stud 34 and cover strips 132 are not included. Such elements, however, are identical to the elements discussed above in connection with FIG. 2A.

Figure 3A:
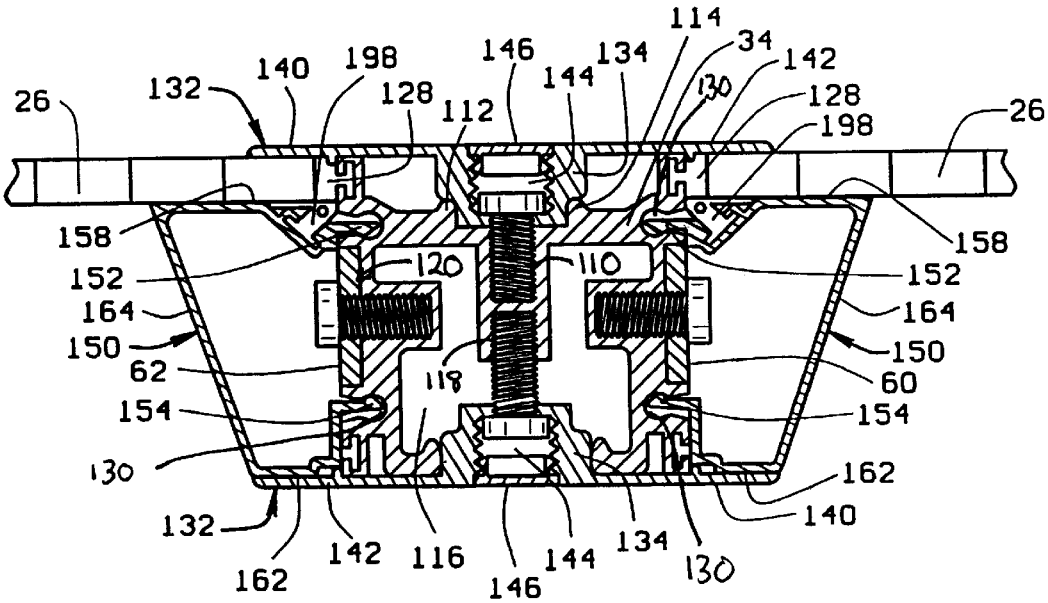
FIG. 3A is a partial cross-sectional view taken along the plane of line 3—3 in FIG. 1, showing a stud mounting (exterior) two window panels or wall panels.

As shown in FIG. 3A, a stud 34 easily adapts to mount (exterior) thinner panels, such as panels 26 for forming windows. In FIG. 3A, one leg of the L-shaped bracket 60 is secured in the groove 120 on each side of the stud 34 with a threaded fastener. The other leg of the bracket 60 is secured to another stud in the frame assembly. Gaskets 128 are mounted on the sides of the studs and sealingly engage the edges of the panels. Inserts 150 are mounted on each side face of the stud 34, with the ribs 152 and 154 extending into the mounting slots 130. Gaskets 198 are mounted on the inserts to sealingly engage the edge margins of the panel. Cover strips 132 are mounted over the front face 100 and the back face 102 of the stud 34. The arms 140 and 142 of the cover strip 132 on the front face overlap the edge margins of the front of the panels 26. The arms 140 and 142 on the cover strip 132 on the back face overlap the back faces 162 of the inserts 150. Threaded fasteners extend through the stems 134 of the T-shaped cross-section of the cover strips 132 and into the ridged troughs 110 and 118 of the front and back faces of the studs to secure the cover strips. A cover 146 can be installed in the channel 144 in the cover strip to hide the fasteners.

Figure 3B:
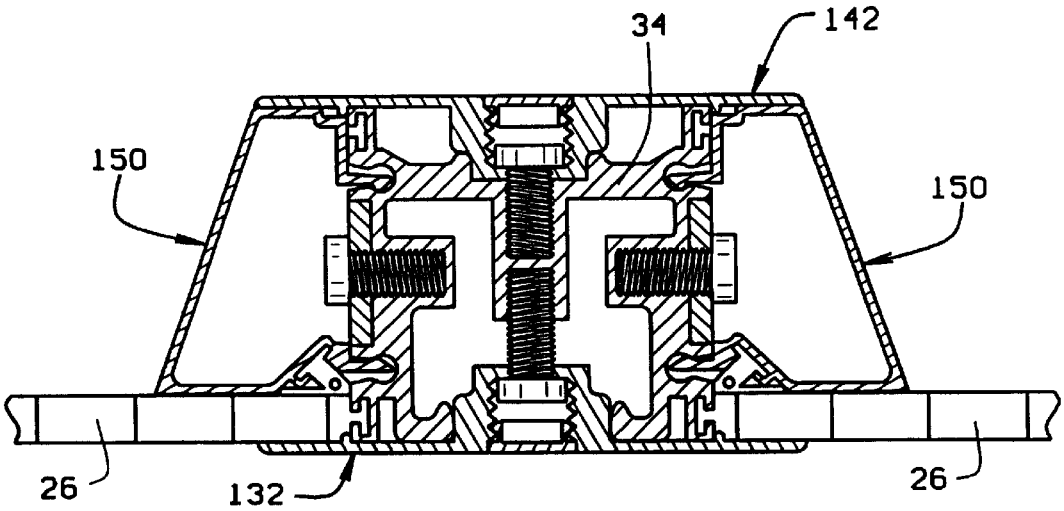
FIG. 3B is the same view showing a stud mounting (interior) two window panels or wall panels.

In FIG. 3B, the stud 34 easily adapts to mount (interior) panels 26. For ease of illustration and understanding, in FIG. 3B, many reference numerals indicating the various elements of stud 34 and cover strip 132 are not included. Such elements, however, are identical to the elements discussed above in connection with FIG. 3B.

Figure 4:
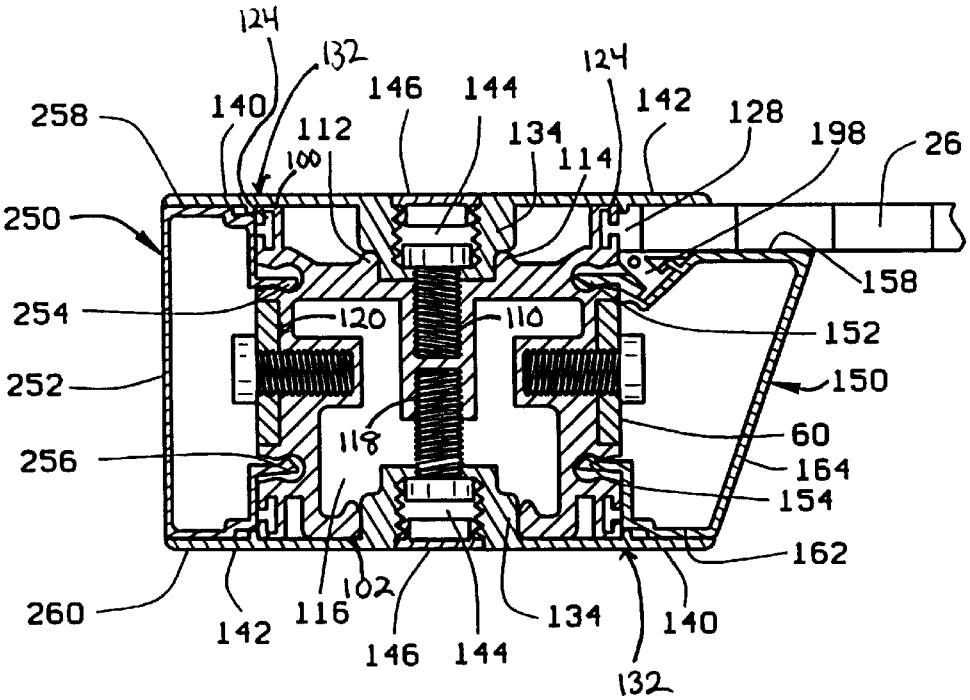
FIG. 4 is a partial cross-sectional view taken along the plane of line 4—4 in FIG. 1, showing a stud mounding one window panel or wall panel at the end of a wall.

As shown in FIG. 4, another special insert 250 can be used to provide a closed end to the wall system. In FIG. 4, one leg of the L-shaped bracket 60 is secured in the groove 120 on one side of the stud 34 with a threaded fastener. The other leg of the bracket 60 is secured to another stud in the frame assembly. Gasket 128 is mounted in the slots 124 on the side face of the stud and sealingly engage the edges of the panels 26. An insert 150 is mounted on the side face of the stud 34, with the ribs 152 and 154 extending into the mounting slots 130. Gasket 198 is mounted on the inserts to sealingly engage the edge margins of the panels 26. On the opposite side of the stud, the insert 250 forming a flat end face 252 is mounted on the stud, with the ribs 254 and 256 extending into the mounting slots 130 on the stud 34. Cover strips 132 are mounted over the front face 100 and the back face 102 of the stud 34. The arm 142 of the cover strip 132 on the front face 100 of the stud 34 overlaps the edge margins of the front of the panel 26, and the arm 140 overlaps the front face 258 of the insert 250. The arm 140 on the cover strip 132 on the back face 102 of the stud 34 overlaps the back face 162 of the insert 150, and the arm 142 on the cover strip overlaps the back face 260 of the insert 250. Threaded fasteners extend through the channels 144 of the cover strips 132 and into the ridged troughs 110 and 118 of the front and back faces of the studs to secure the cover strips. A cover 146 can be installed in the channels 144 in the cover strips to hide the fasteners.

As shown in FIG. 5, where full length panels 302 are used, a simplified stud 310 can be used. The panels 302 are placed on either side of the stud 310 with the ribs 326 and 328 on the underside of the arms 314 and 316 engaging the edges of the panels, and spacing them apart. A cover strip 132 is mounted over the end of the stem 312 to sandwich the edge margins of the panels 280 between the arms of the cover strip 132 and the arms 314 and 316 of the stud 310. The cover strip 132 is secured with threaded fasteners extending through the channel 144 and into the ridged groove. A cover 146 can be placed over the channel 144 to hide the fasteners.

Figure 14:
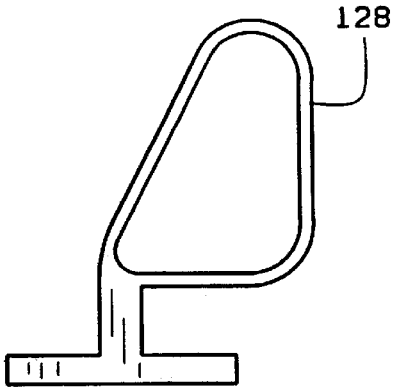
FIG. 14 is a cross-sectional view of a gasket for use in sealing 1⅞" panels.

FIG. 14 is a cross-sectional view of a gasket 128 for use in sealing 1⅞" panels. Gaskets 128 are shown in connection with the stud 34 in FIG. 2A, for example.

Figure 15:
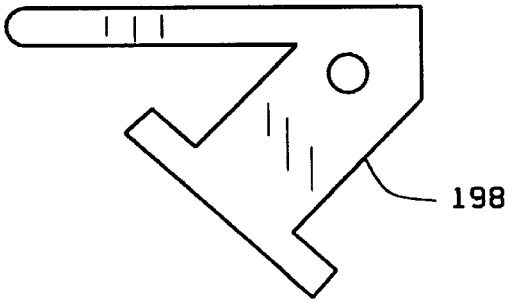
FIG. 15 is a cross-sectional view of a gasket for use in sealing thin panels.

FIG. 15 is a cross-sectional view of a gasket 198 for use in sealing thin panels. Gaskets 198 are shown in connection with the stud 34 in FIG. 2B, for example.

Figure 16:
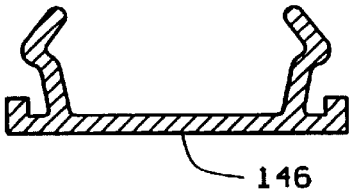
FIG. 16 is a cross-sectional view of a flexible extruded cover to conceal fasteners in a cover plate.

FIG. 16 is a cross-sectional view of a flexible extruded cover 146 which may be used to conceal fasteners in a cover plate.

Figure 17:
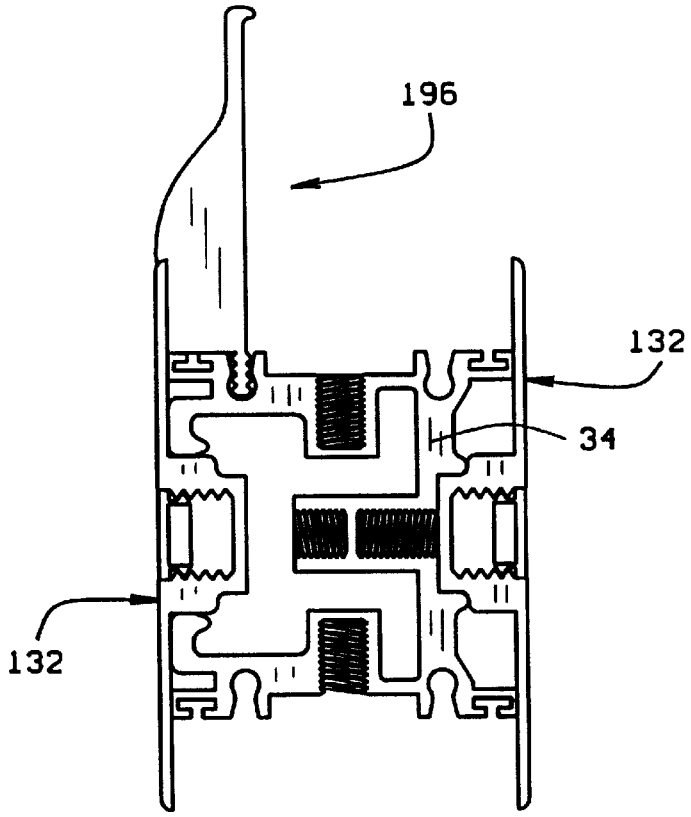
FIG. 17 is a cross-sectional view of a bulkhead gasket mounted to the stud.

FIG. 17 is a cross-sectional view of a bulkhead gasket 196 to interface with existing equipment.

Figure 18:
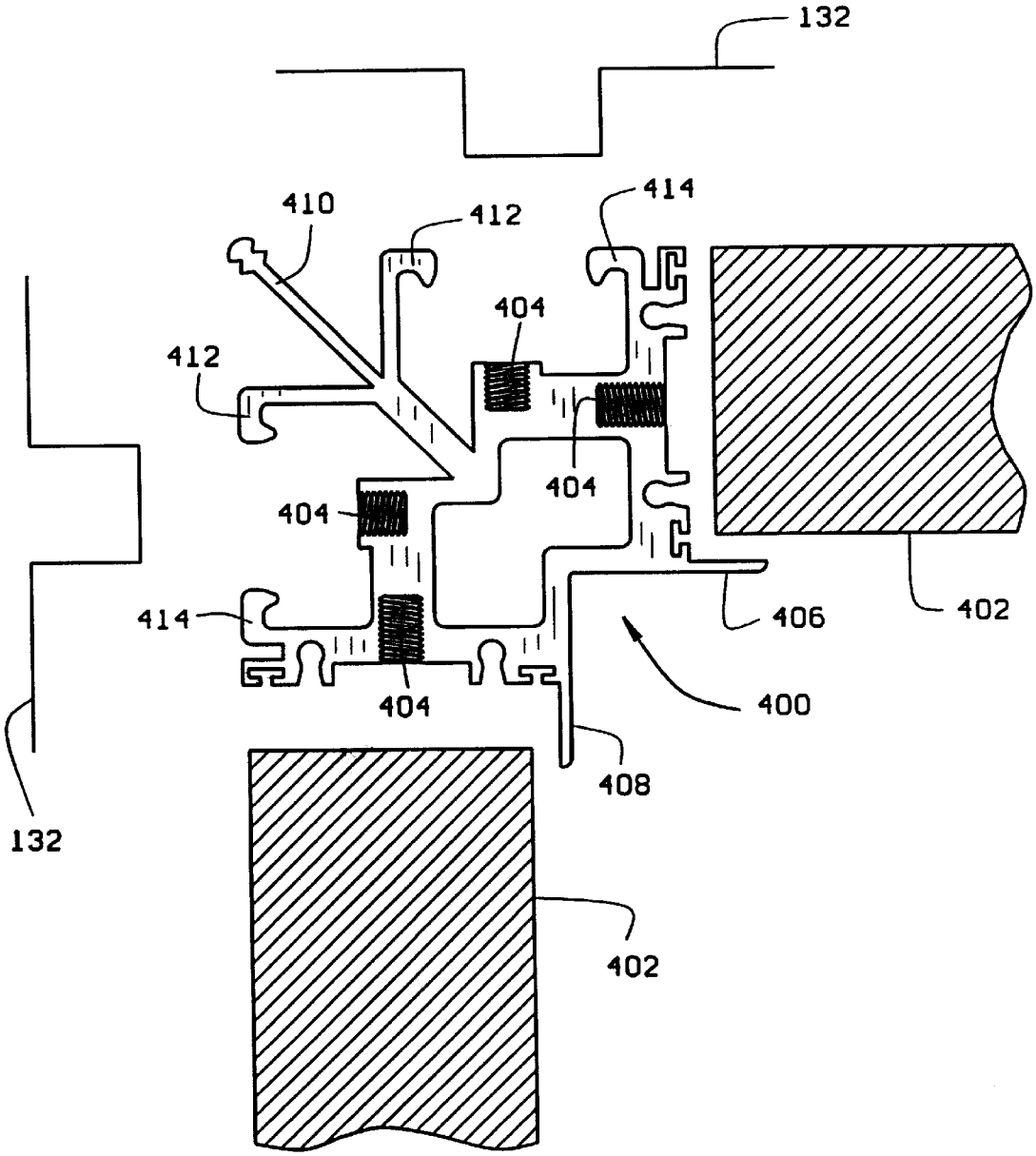
FIG. 18 is a cross-sectional view of a corner post.

FIG. 18 is a cross-sectional view of a comer post 400 with the cover plates 132 shown in exploded form. Comer post 400 is configured to receive panels 402. Post 400 includes troughs 404 therein for receiving threaded fasteners. Aligning arms 406 and 408 facilitate aligning panels 402 with post 400. Post 400 also includes a mast 410 having stiffening extensions 412 for supporting cover plates 132. Flanges 414 also provide support for cover plates 132. Cover plates 132 and respective arms 406 and 408 cooperate to trap respective panels 402 therebetween.

Figure 19:
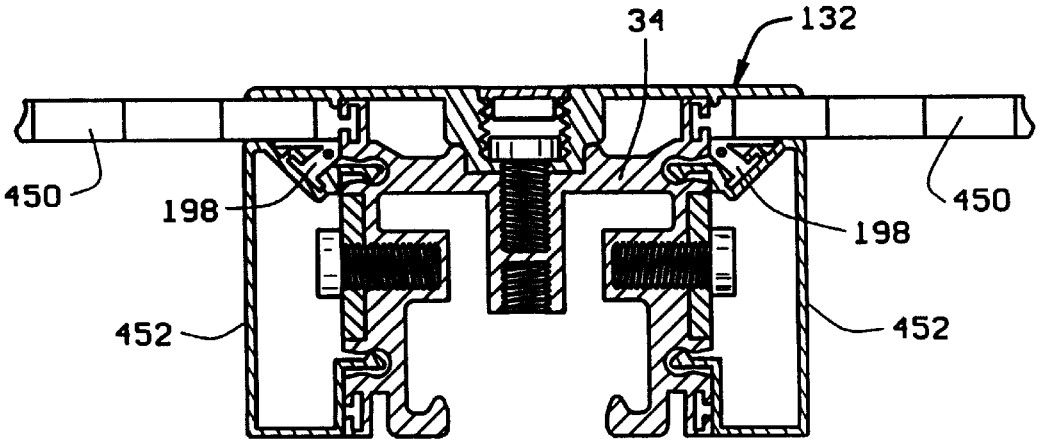
FIG. 19 is a cross-sectional view of a stud mounting (interior) a ¼" panel.

FIG. 19 is a cross-sectional view of the stud 34 mounting (exterior) ¼" panels 450. Flat inserts 452 also are illustrated as being secured to the stud 34, and gaskets 198 are utilized for sealing the panels 450.

Figure 20A:
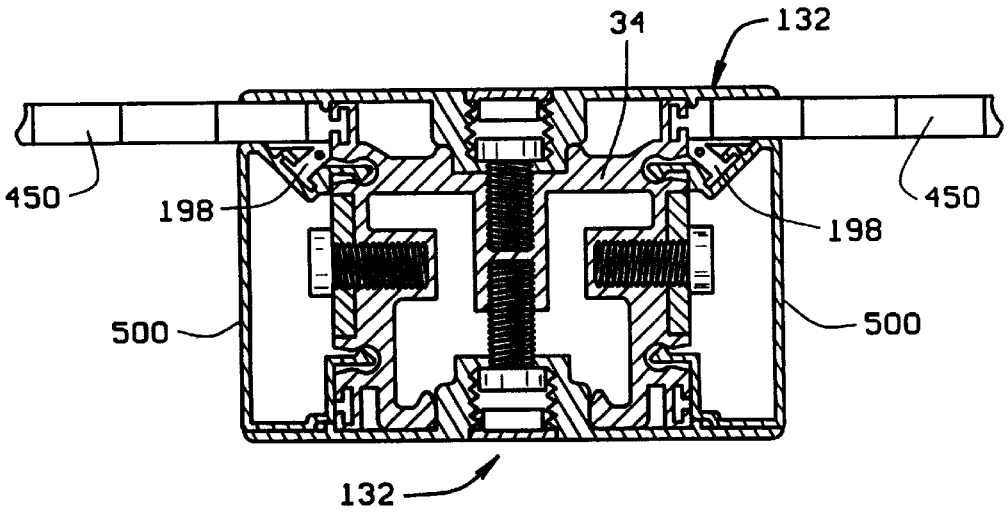
FIG. 20A is a cross-sectional view of a stud mounting (exterior) a ¼" panel.
Figure 20B:
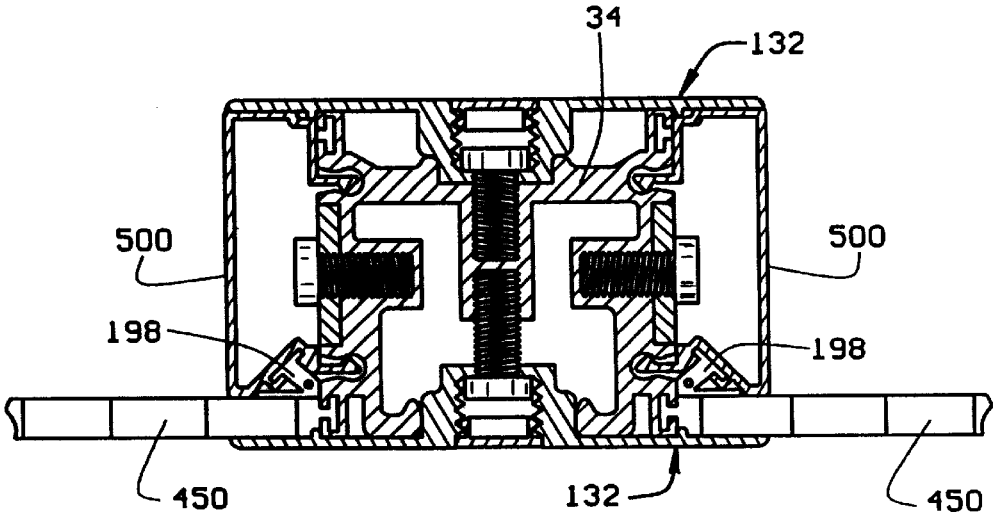
FIG. 20B is a cross-sectional view of a stud mounting (interior) a ¼" panel.

FIG. 20A is a cross-sectional view of the stud 34 mounting (exterior) 1⅞" panel 450. An alternative embodiment of flat inserts 500 are illustrated as being secured to the stud 34. FIG. 20B is a cross-sectional view of stud 34 mounting (interior) ¼" panel 450 also utilizing flat inserts 500.

Figure 21A:
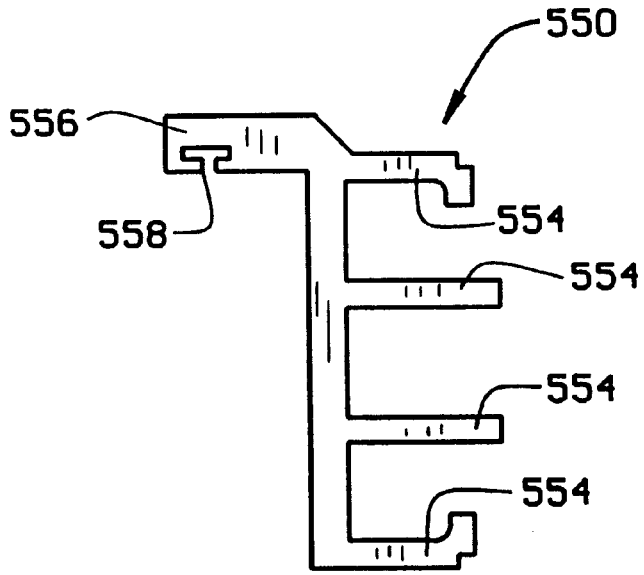
FIGS. 21A and 21B are views of a door side jamb and a door header jamb, respectively.
Figure 21B:
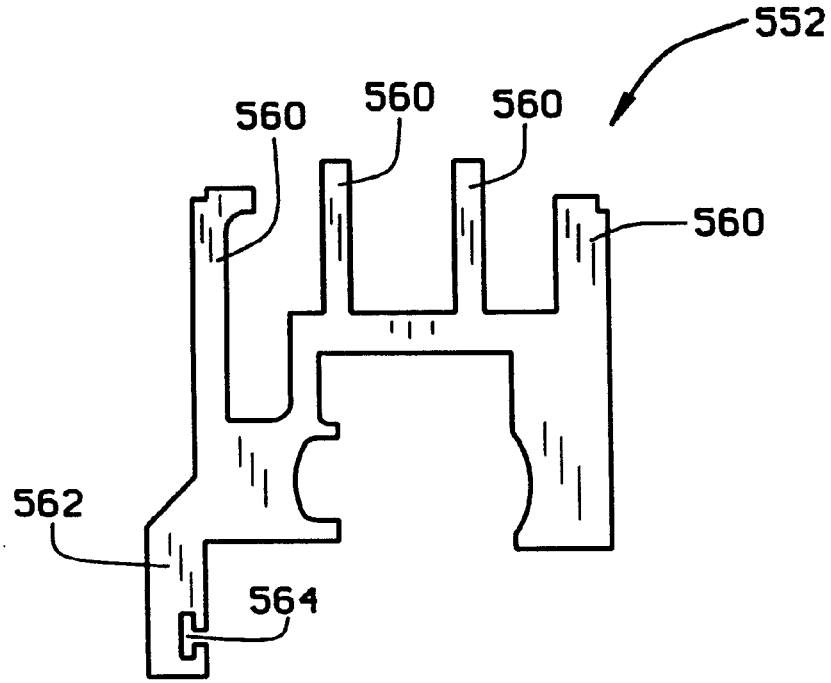

FIGS. 21A and 21B are views of a door side jamb 550 and a door header jamb 552, respectively. With side jamb 550, extensions 554 mate with the stud 34 and extension 556 includes a T-slot 558 for receiving material against which a door closes. With header jamb 552, extensions 560 mate with the stud 34, and extension 562 includes a T-slot 564 for receiving material against which a door closes.

What is claimed is:

1. A modular wall system comprising a framing assembly supporting a plurality of wall panels, the framing assembly including top members, bottom members, and studs extending between the top and bottom members supporting the wall panels, each stud having a generally rectangular cross-section with a front face, a back face, and left and right side faces, the front face having a recess therein with a longitudinally extending ridged trough therein for receiving threaded fasteners; the back face having an out hardly-opening generally C-shaped channel with a longitudinally extending ridged trough therein for receiving threaded fasteners; and each side face having a generally centrally located, longitudinally extending groove with a ridged trough in the groove for receiving threaded fasteners, at least one longitudinally extending gasket mounting slot and a gasket in the gasket mounting slot sealing against the side edge of one of the panels which is mounted on the side of the stud, and an insert mounting slot between the groove and each gasket mounting slot; and a cover strip mounted over the front face of the stud, the cover strip having a generally T-shaped cross-section adapted to interfit with the front face of the stud with the stem of the "T" fitting in the recess in the front face, and the arms of the "T" extending laterally beyond side edges of the front face to overlap edge margins of the front face of the panel mounted on the side of the stud, and a plurality of threaded fasteners extending through the stem of the "T" shaped cross-section of the cover and into the ridged trough in the front face.

2. The modular wall system according to claim 1 further comprising a cover strip mounted on the back face of the stud, the cover strip having a generally T-shaped cross-section adapted to interfit with the back face of the stud with the stem of the "T" fitting into the channel in the back face, and the arms of the "T" extending laterally beyond side edges of the back face to overlap edge margins of the back face of the panel mounted on the side of the stud, and a plurality of threaded fasteners extending through the stem of the "T" shaped cross-section of the cover strip and into the ridged trough of the back.

3. The modular wall system according to claim 1 further comprising a plurality of L-shaped brackets securing the studs to the other members and studs of the framing assembly, one leg of the L-shaped brackets adapted to fit within the groove of the side face of the stud and be secured thereto with at least one threaded fastener extending through the leg of the bracket and into the ridged trough in the groove.

4. The modular wall system according to claim 1 wherein the C-shape channel extends from the back face to a depth of more than one half of the width of the left and right side faces.

5. A stud and wall panel combination for forming walls in a modular wall, the stud having a generally rectangular cross-section with a front face, a back face, and left and right side faces, the front face having a recess therein with a longitudinally extending ridged trough therein for receiving threaded fasteners; the rear face having an outwardly opening generally C-shaped channel with a longitudinally extending ridged trough therein for receiving threaded fasteners; each side face having a generally centrally located, longitudinally extending groove with a ridged trough in the groove for receiving threaded fasteners, a longitudinally extending gasket mounting slot in the side faces adjacent each of the front and back faces, and an insert mounting slot between the groove and each gasket mounting slot;

a longitudinally extending gasket in the gasket mounting slot, a panel, having a front and back surface, and side edges abutting each side of the stud, the side edges of each panel engaging the gasket of its respective side of the stud, cover strips mounted over the front and back faces of the stud, each cover strip having a generally T-shaped cross-section adapted to interfit with the front and back faces of the stud with the respective stem of the "T" fitting in the recess in the front face and the opening in the C-shaped channel in the back face, and the respective arms of the "T" extending laterally beyond side edges of the front face and the back face to overlap edge margins of the panels and engage the panels placed in abutment with the stud, the cover strips being secured to the front and back faces of the stud with threaded fasteners extending through the stem of the "T" shaped cross-section of the cover strip and into the ridged trough in the front or back face, respectively.

6. The stud and wall panel combination according to claim 5 wherein the C-shaped channel is deeper than more than one half of the width of the left and right side faces.

7. A stud for a framing system in a modular wall system, the stud having a generally rectangular cross-section with a front face, a back face and, left and right side faces, the front face having a recess therein with a longitudinally extending ridged trough therein for receiving threaded fasteners; the rear face having an outwardly opening generally C-shaped channel with a longitudinally extending ridged trough therein for receiving threaded fasteners; each side face having a generally centrally located, longitudinally extending groove with a ridged trough in the groove for receiving threaded fasteners, a longitudinally extending gasket mounting slot adjacent each of the front and back faces, and an insert mounting slot between the groove and each gasket mounting slot which opens to the side face.

8. The stud according to claim 7 wherein the stud includes a cover for the front face of the stud.

9. The stud according to claim 7 wherein the stud includes covers for the front and back faces of the stud.

10. The stud according to claim 7 wherein the C-shaped channel extends from the back face beyond the middle of the left and right side faces.

11. A stud for a framing system in a modular wall system, the stud having a generally rectangular cross-section with a front face, a back face, and left and right side faces, the front face having a recess therein with a longitudinally extending ridged trough therein for receiving threaded fasteners; the rear face having an outwardly opening generally C-shaped channel with a longitudinally extending ridged trough therein for receiving threaded fasteners; each side face having a generally centrally located, longitudinally extending groove with a ridged trough in the groove for receiving threaded fasteners, the C-shaped channel extending from the back face to a depth of more than half of the width of the left and right side faces.

12. The stud according to claim 11 further comprising a longitudinally extending gasket mounting slot on each side face adjacent each of the front face and the back face.

* * * * *